United States Patent [19]

Parisien

[11] 4,159,820

[45] Jul. 3, 1979

[54] FENCE POST CAP AND BARBED WIRE ARM

[76] Inventor: Rudolph E. Parisien, 891 Rainbow St., Ottawa, Ontario, Canada

[21] Appl. No.: 840,047

[22] Filed: Oct. 6, 1977

[30] Foreign Application Priority Data

Nov. 1, 1976 [CA] Canada ..... 264519

[51] Int. Cl.[2] ..... E04H 17/06

[52] U.S. Cl. ..... 256/11; 403/386; 403/399

[58] Field of Search ..... 256/2, 11, 24, 59, 65, 256/47; 248/245; 403/188, 386, 389, 399; 52/285

[56] References Cited

U.S. PATENT DOCUMENTS

| | | | |
|---|---|---|---|
| 3,343,811 | 9/1967 | Kusel et al. | 256/65 X |
| 3,847,489 | 11/1974 | Van Riper | 256/59 X |
| 4,065,103 | 12/1977 | Sweezey | 256/11 |

FOREIGN PATENT DOCUMENTS

| | | | |
|---|---|---|---|
| 592079 | 4/1959 | Italy | 52/285 |

*Primary Examiner*—Werner H. Schroeder
*Attorney, Agent, or Firm*—A. W. Breiner

[57] ABSTRACT

A fastener for securing a fence post cap to a channel type post. The fence post cap has a side wall and a bottom wall received in the open upper end of the post and a top wall which extends away from the post to engage a horizontal top rail of the fence. The bottom wall of the cap has an aperture through which a bolt extends. The fastener is a curved sheet metal member having an aperture to receive the bolt. A nut provided on the bolt can be tightened to cause the sheet metal member to be flattened whereby its edges bite in to the interior walls of the post. The fastening means is also used to secure a barbed wire arm to the post. The base of the barbed wire arm extends into the post so as to be adjacent the bottom wall of the cap and the bolt extends through the base of the barbed wire arm as well as passing through the bottom wall of the cap and the fastening means.

7 Claims, 6 Drawing Figures

FENCE POST CAP AND BARBED WIRE ARM

This invention relates to fence post caps and more particularly to a fence post cap which is adapted to be fastened to the post and be provided with a barbed wire arm.

In known fence systems the post cap is received on the open upper end of the tubular post and the horizontal top rail of the fence is inserted through an aperture in the top of the post cap. When a barbed wire arm is provided the arm is usually integral with the post cap so that it is held in place by the top rail which extends through the post cap. There is usually no convenient means for holding the fence caps against upward movement. Since it is desireable to restrain the cap or the cap and barbed wire arm against upward movement where the contours of the land such as hills or hollows would tend to cause upward pressure on the top rail or the barbed wire and it is also desireable to prevent vandals from lifting the post cap to gain access to the enclosure it is necessary to drill aligned holes through the cap and post on the construction site so that bolts can be inserted.

It is therefor an object of the present invention to provide a fence post cap and a barbed wire arm adapted to be secured thereto which can be secured in the open upper end of a channel type fence post so as to resist upward movement relative to said post.

Accordingly the present invention provides a fence post cap said fence post cap having a side wall, and a bottom wall adapted to be received in an open upper end of a channel type fence post and a top wall including a depending flange and a projection on said side wall adapted to engage a horizontal top rail of said fence said top wall being adapted to leave at least a portion of said end of said post uncovered whereby a lower end of a barbed wire arm is adapted to be received in said upper end of said post.

In the accompanying drawings which illustrate embodiments of the invention

Figure 1:
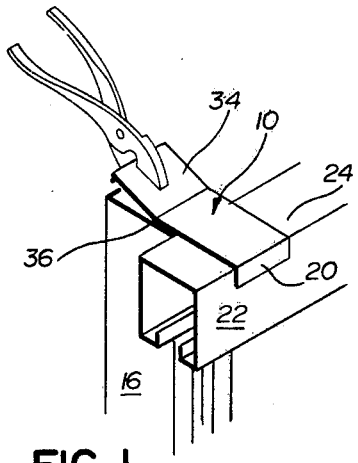
FIG. 1 is a perspective view of the fence post cap a portion of which is being removed so that a barbed wire arm can be received in the upper end of the post.
Figure 5:
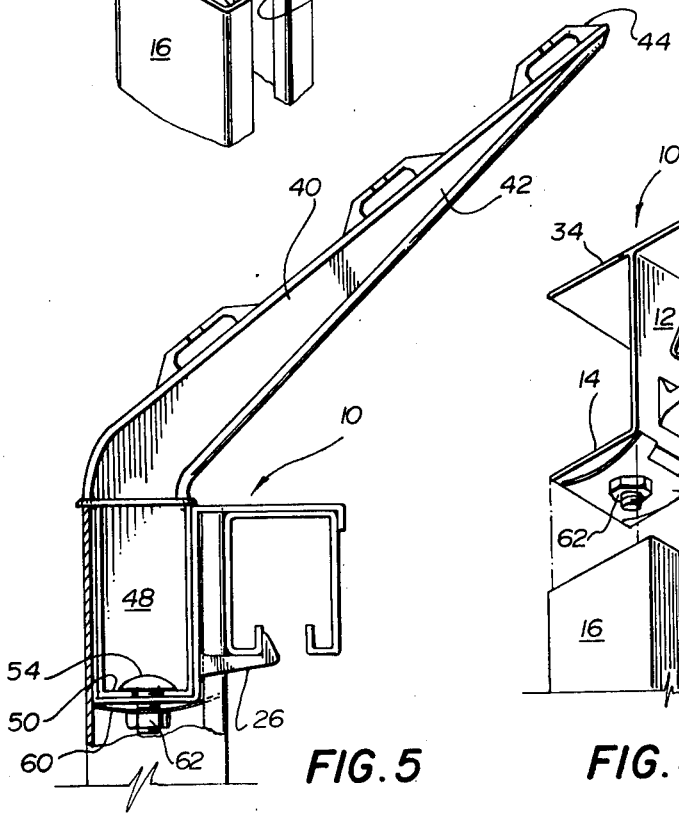
FIG. 5 is a side elevational view of the fence post cap and barbed wire arm and FIG. 6 is a side elevational view of the fence post cap prior to installation on the fence post.
Figure 6:
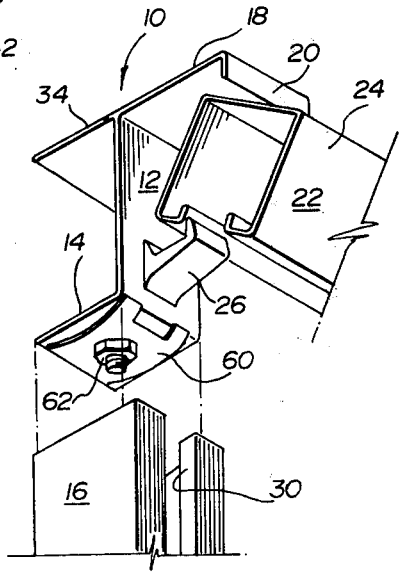

Referring now in detail to the drawings the fence post cap shown generally at 10 in FIGS. 5 & 6 includes a side wall 12 and a bottom wall 14 adapted to be received in a channel type fence post 16. A top wall 18 of the cap extends away from the post 16 and has a depending flange 20 which engages a side wall 22 of a top rail 24 of the fence. A projection 26 on the side wall of the cap 10 extends through a slot 30 in the post 16 and into a similar slot 32 in the rail 24. The flange 20 and the projection 26 hold the rail against the upper portion of the post 16. It will be noted that the cap 10 as shown in FIGS. 1 and 6 is provided with a top wall portion 34 which covers the open upper end of the post 16. However, the top wall portion can easily be removed by bending it along a weakened portion 36 as shown in FIG. 1 so as to separate the portion 34 from the cap 10.

Figure 2:
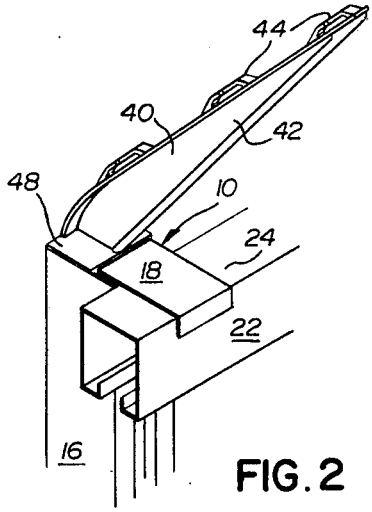
FIG. 2 is a perspective view of the barbed wire arm in place on the cap.
Figure 4:
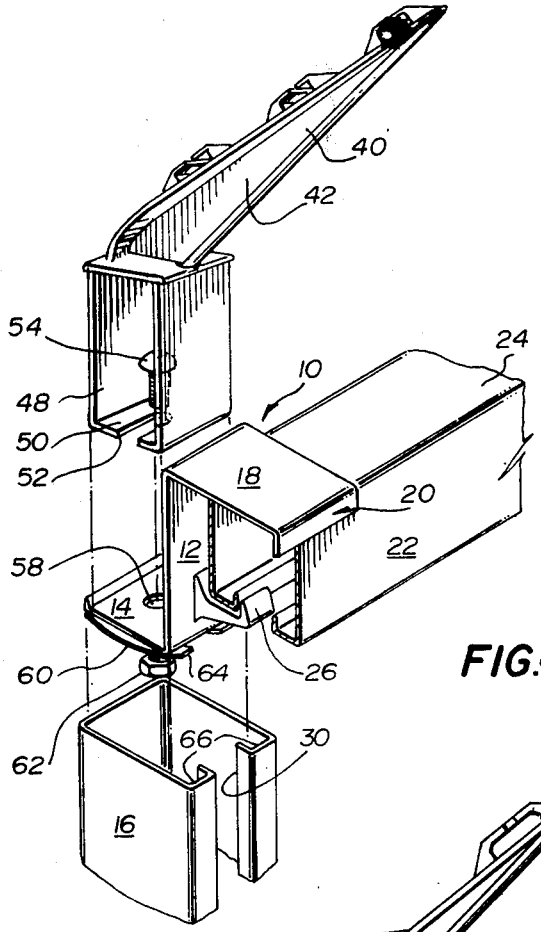
FIG. 4 is an exploded perspective view of the fence post cap and barbed wire arm

The top wall portion 34 is removed to facilitate installation of a barbed wire arm 40 shown in FIGS. 2,4 and 5. The barbed wire arm includes an arm 42 having hooks 44 to receive strands of barbed wire 46. The arm 40 has a base 48 in the form of a rectangular box which is open on one side. The base 48 is adapted to be received in the upper end of the post when the cap 10 is in position thereon. The top wall of the base 48 is larger than the bottom wall 50 so that the end of the post is covered. The bottom wall 50 of the base 48 has a slot 52 to receive a carriage bolt 54. The square portion of the head of the bolt 54 engages the slot so that the bolt 54 is prevented from turning. The bolt 54 is adapted to extend through an aperture 58 in the bottom wall 14 of the cap 10. The bolt 54 also extends through an aligned aperture in a curved sheet metal member 60 on the underside of the bottom wall of the cap 10 and a nut 62 is provided on the end of the bolt 54. The sheet metal member 60 has approximately the same dimensions as the interior of the post 16 and has a pair of tabs 64 which are received in J-shaped portions 66 of the post.

Figure 3:
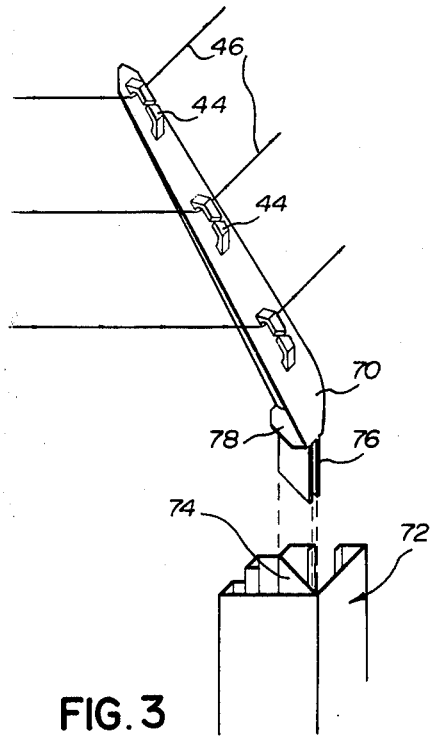
FIG. 3 is a perspective view of an alternative form of barbed wire arm for use on a corner post

In FIG. 3 a modified barbed wire arm shown at 70 is adapted for use on a corner post 72 in the form of two channel members disposed at right angles to each so that the channels share a common connecting wall 74. The arm 70 is therefore provided with a base 76 which is bifurcated to receive the upper portion of the connecting wall 74 of the post 72 when the lower portion of the base 76 is inserted in the open upper end of the corner post 72.

The arm 70 is conveniently molded of suitable material such as aluminum alloy in the similar manner to that of the barbed wire arm 40 and has a plurality of hooks 44 to hold the strands of barbed wire 46. The base of 76 of the barbed wire arm 70 is also provided with a cap portion 78 which covers at least part of the open upper end of the corner post 72.

It should be pointed out that it is usually not necessary to restrain a barbed wire arm 70 on corner post against upward movement since the barbed wire will tend to prevent upward movement and therefore no fastening means has been provided.

In use the cap 10 and barbed wire arm are assembled as shown in FIG. 4 prior to being inserted in the open upper end of the post 16. The toprail 24 is also assembled on cap 10 by rotating it as shown in FIG. 6. The complete assembly is then mounted on the fence post as shown in FIG. 5. The nut 62 on the carriage bolt 54 is tightened by inserting a flexible drive socket wrench into the post 16 through the slot 30. Tightening of the nut 62 in this manner causes the sheet metal member 60 to be flattened thus increasing its length so that the end edges are wedged against the interior walls of the post 16.

I claim:

1. A fence post cap said cap having a side wall, and a bottom wall adapted to be received in an open upper end of a channel type fence post, a top wall including a depending flange, a projection on said side wall adapted to engage a horizontal top rail of said fence and a curved sheet metal member secured to said bottom wall by adjustable means capable of being tightened, said curved sheet metal member and adjustable means being constructed and arranged whereby tightening of said adjustable means causes said sheet metal member to flatten to the extent that edges of said sheet metal member are wedged against inner walls of said post to hold said cap against upward movement.

2. A fence post cap said cap having a side wall, and a bottom wall adapted to be received in an open upper end of a channel type fence post, a top wall including a depending flange and a projection on said side wall adapted to engage a horizontal top rail of said fence said top wall being adapted to leave at least a portion of said end of said post uncovered and a lower end of a barbed wire arm received in said upper end of said post and secured to said bottom wall of said cap.

3. A fence post cap as claimed in claim 2 wherein said lower end of said barbed wire arm is received in said upper end of said post and secured to said bottom wall of said cap by adjustable means.

4. The fence post cap as claimed in claim 3 wherein said adjustable means is a nut and bolt.

5. The fence post cap as claimed in claim 3 wherein said adjustable means is a sheet metal screw.

6. The fence post cap as claimed in claim 3 wherein said adjustable means is a bolt received in a threaded aperture in the barbed wire arm.

7. The fence post cap as claimed in claim 3 wherein said adjustable means is a bolt received in a threaded aperture in the cap.

* * * * *